US009523259B2

(12) United States Patent
Christie

(10) Patent No.: US 9,523,259 B2
(45) Date of Patent: Dec. 20, 2016

(54) VERTICAL SUBSEA TREE ANNULUS AND CONTROLS ACCESS

(71) Applicant: GE Oil & Gas UK Limited, Aberdeen (GB)

(72) Inventor: David Stewart Christie, Aberdeen (GB)

(73) Assignee: GE Oil & Gas UK Limited, Aberdeen (GB)

( * ) Notice: Subject to any disclaimer, the term of this patent is extended or adjusted under 35 U.S.C. 154(b) by 0 days.

(21) Appl. No.: 14/639,256

(22) Filed: Mar. 5, 2015

(65) Prior Publication Data

US 2016/0258247 A1 Sep. 8, 2016

(51) Int. Cl.
*E21B 34/04* (2006.01)

(52) U.S. Cl.
CPC ..... *E21B 34/04* (2013.01)

(58) Field of Classification Search
CPC ..... E21B 33/035; E21B 33/043; E21B 34/04
See application file for complete search history.

(56) References Cited

U.S. PATENT DOCUMENTS 3,268,241 A * 8/1966 Word, Jr. ..... E21B 33/043 166/368
3,353,364 A * 11/1967 Blanding ..... B63C 11/44 114/314
5,465,794 A * 11/1995 McConaughy ..... E21B 33/04 166/375
5,544,707 A * 8/1996 Hopper ..... E21B 33/03 166/368
5,868,204 A * 2/1999 Pritchett ..... E21B 33/043 166/368
5,971,077 A * 10/1999 Lilley ..... E21B 33/035 166/348
6,076,605 A 6/2000 Lilley et al.
6,474,417 B1 * 11/2002 Blair ..... E21B 33/035 166/368
6,581,691 B1 * 6/2003 Jennings ..... E21B 33/043 166/348
6,705,401 B2 * 3/2004 Buckle ..... E21B 33/035 166/337
6,902,005 B2 * 6/2005 Radi ..... E21B 33/0355 166/345
7,331,396 B2 * 2/2008 Reimert ..... E21B 33/035 166/319

(Continued)

*Primary Examiner* — Matthew R Buck
*Assistant Examiner* — Aaron Lembo
(74) *Attorney, Agent, or Firm* — Hogan Lovells US LLP

(57) ABSTRACT

A wellhead assembly includes a tubular housing assembly having a housing sidewall, an axial bore, and a housing annulus passage extending from the axial bore through the housing sidewall. A tubing hanger is secured to a string of tubing and is selectively landed in the housing assembly. The tubing hanger has a vertical bore in fluid communication with the axial bore. A vertical tree assembly is selectively landed on the housing assembly, the vertical tree assembly having a tree member located axially above the tubing hanger. The tree member has a lateral bore for directing a flow of production fluid from a well. A tree annulus passage extends through a sidewall of the tree member. An external annulus passage extends external of the tree member and the housing assembly and is in fluid communication with the housing annulus passage and the tree annulus passage.

18 Claims, 4 Drawing Sheets

(56) References Cited

U.S. PATENT DOCUMENTS

| | | | | |
|---|---|---|---|---|
| 7,992,633 | B2 * | 8/2011 | Donald | E21B 33/03 166/105 |
| 8,245,787 | B2 * | 8/2012 | White | E21B 33/035 166/344 |
| 8,371,385 | B2 * | 2/2013 | Lewis | E21B 33/035 166/341 |
| 8,590,625 | B1 * | 11/2013 | Smith | E21B 33/0385 166/344 |
| 8,794,334 | B2 * | 8/2014 | June | E21B 33/035 166/251.1 |
| 2001/0011593 | A1 * | 8/2001 | Wilkins | E21B 33/035 166/368 |
| 2004/0104024 | A1 * | 6/2004 | Kent | E21B 33/0355 166/85.4 |
| 2007/0169940 | A1 * | 7/2007 | Fenton | E21B 33/035 166/368 |
| 2009/0236100 | A1 * | 9/2009 | Lawson | E21B 33/043 166/339 |
| 2013/0062056 | A1 * | 3/2013 | Broussard | E21B 33/04 166/250.15 |
| 2014/0238687 | A1 * | 8/2014 | Donald | E21B 34/045 166/368 |
| 2015/0053412 | A1 * | 2/2015 | June | E21B 33/043 166/348 |
| 2015/0191994 | A1 * | 7/2015 | Kobe | E21B 33/04 166/350 |
| 2015/0330194 | A1 * | 11/2015 | June | E21B 17/003 166/351 |

* cited by examiner

VERTICAL SUBSEA TREE ANNULUS AND CONTROLS ACCESS

BACKGROUND

1. Field of Disclosure

This disclosure relates in general to wellhead assemblies, and in particular to wellhead assembly members for providing control of wellhead assembly operations.

2. Description of Related Art

Some conventional subsea wellhead assemblies include a high pressure wellhead housing that supports one or more casing hangers located at upper ends of strings of casing extending into the well. A tubing hanger lands in the wellhead housing above the casing hanger and supports a string of production tubing that extends through the smallest diameter casing. The tubing hanger has a production bore which is offset slightly from the longitudinal axis. An annulus bore also extends through the tubing hanger, parallel to and offset from the axis, for communicating the tubing annulus to above the tubing hanger. The annulus bore is needed during installation of the tubing hanger and tubing to establish circulation down the tubing and back up the annulus. After the well has been completed, a removable plug is installed in the annulus bore, then a production tree is mounted to the wellhead housing. Access through the production tree to the tubing may be made for various workover operations that are needed. Various production valves and chokes will be mounted to the tree. Typically the bore of a subsea wellhead is limited, and may be for example, 18-¾ inches. Having both a production line and annulus bore traveling through the wellhead assembly constrains the sizes of production tubing that can be used, and limits the number of well controls and monitoring lines that can be included within the wellhead.

SUMMARY OF THE DISCLOSURE

The methods and systems of the current disclosure removes complexity of providing annulus access and controls from a constrained area on the tubing hanger, thus allowing the largest possible production tubing and well productivity. Embodiments of this disclosure also allow more measuring and control lines for the reservoir compared to some current systems, thus improving the long term productivity of the reservoir.

In an embodiment of this disclosure, a wellhead assembly includes a tubular housing assembly having a housing sidewall, an axial bore, and a housing annulus passage extending from the axial bore through the housing sidewall. A tubing hanger is adapted to be secured to a string of tubing and is selectively landed in the housing assembly. The tubing hanger has a vertical bore in fluid communication with the axial bore. A vertical tree assembly is selectively landed on the tubular housing assembly, the vertical tree assembly having a tree member located axially above the tubing hanger. The tree member has a lateral bore for directing a flow of production fluid from a well. A tree annulus passage extends through a sidewall of the tree member. An external annulus passage extends external of the tree member and the housing assembly. The external annulus passage is in fluid communication with the housing annulus passage and the tree annulus passage.

In an alternate embodiment of this disclosure, a wellhead assembly includes a tubular housing assembly having, an axial bore, and a housing annulus passage having a first end located at an outer diameter of the tubular housing assembly and a second end located at surface of the axial bore. A tubing hanger is adapted to be secured to a string of tubing and selectively sealingly engages the axial bore of housing assembly above the second end of the housing annulus passage. The tubing hanger has a vertical bore in fluid communication with the axial bore. A vertical tree assembly is selectively landed on the tubular housing assembly. The vertical tree assembly includes a tree member located axially above the tubing hanger. The tree member has a lateral bore for directing a flow of production fluid from a well. The vertical tree assembly also includes a tree annulus passage with a first end at an upper interface of the tree member and a second end at an outer diameter of the tree member. The vertical tree assembly further includes an external annulus passage extending external of the tree member and the housing assembly. The external annulus passage is in fluid communication with the housing annulus passage and the tree annulus passage. The vertical tree assembly also includes a valve assembly engaging the outer diameter of the tree member. The valve assembly has a tree open position to allow an annulus fluid to flow into and out of the tree annulus passage and a housing open position to allow the annulus fluid to flow into and out of the housing annulus passage.

In another alternate embodiment of this disclosure, a method for completing a subsea well includes providing a tubular housing assembly having a housing sidewall, an axial bore, and a housing annulus passage extending from the axial bore through the housing sidewall. The housing assembly can be installed subsea at an upper end of the subsea well. A string of tubing can be secured to a tubing hanger and the tubing hanger can be landed in the housing assembly. The tubing hanger has a vertical bore in fluid communication with the axial bore. A vertical tree assembly can be provided. The vertical tree assembly has a tree member. The tree member has a lateral bore for directing a flow of production fluid from the well, and a tree annulus passage extending through a sidewall of the tree member. The vertical tree assembly also has an external annulus passage. The vertical tree assembly can be landed on the housing assembly so that the tree member is axially above the tubing hanger and so that the external annulus passage extends external of the tree member and external of the housing assembly and is in fluid communication with the housing annulus passage and the tree annulus passage.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
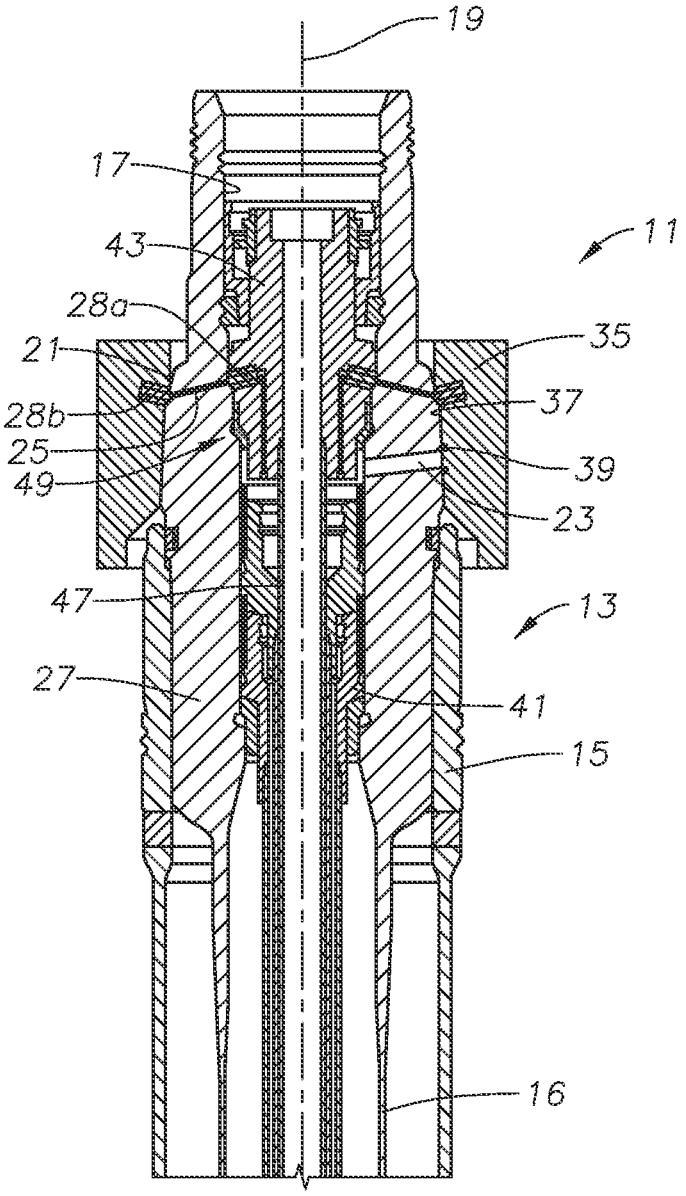
FIG. 1 is a section elevation view of a subsea wellhead assembly in accordance with an embodiment of this disclosure, shown prior to the vertical tree assembly being installed.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, wellhead assembly 11 is located in a subsea environment and associated with a hydrocarbon well. Wellhead assembly 11 includes tubular housing assembly 13. Tubular housing assembly 13 is a tubular member that is mounted on an annular shoulder in a bore of base 15 that is supported on the sea floor. Tubular housing assembly 13 is secured to the upper end of a string of conductor pipe 16 that extends into the well to a first depth. Tubular housing assembly 13 has an axial bore 17 and an axial bore axis 19 that extends through the center of axial bore 17. Tubular housing assembly 13 is a tubular member that has an outer diameter that changes to define housing tree interface surface 21. Housing tree interface surface 21 is an annular upward facing sloped surface on an outer diameter of tubular housing assembly 13 so that the outer diameter of tubular housing assembly 13 at a top end of housing tree interface surface 21 is smaller than the outer diameter of tubular housing assembly 13 at a lower end of housing tree interface surface 21. Housing tree interface surface 21 can be a gradual taper that extends a length along the outer diameter surface of tubular housing assembly 13. In alternate embodiments, housing tree interface surface 21 can be a more defined upward facing shoulder on the outer diameter surface of tubular housing assembly 13.

Tubular housing assembly 13 includes housing annulus passage 23. Housing annulus passage 23 extends from axial bore 17 and through a sidewall of tubular housing assembly 13 so that a first end of housing annulus passage 23 is located at an outer diameter of tubular housing assembly 13 and a second end of housing annulus passage 23 is located at surface of axial bore 17. Housing control line 25 extends from axial bore 17 through the housing sidewall. There can be multiple control lines 25 extending from axial bore 17 through the housing sidewall. No valves are part of or attached directly to tubular housing assembly 13, maximizing the amount of space within tubular housing assembly 13 that can be used for the production of hydrocarbons. Inner multi control coupling 28*a* is located at an inner end of housing control line 25 at axial bore 17. Outer multi control coupling 28*b* is located at an outer end of housing control line 25 at an outer diameter of housing assembly 13. Multi-control couplings 28*a*, 28*b* can be, for example, a sphere-seal such as is disclosed in U.S. Pat. No. 8,800,662, which is incorporated herein in its entirety.

Figure 2:
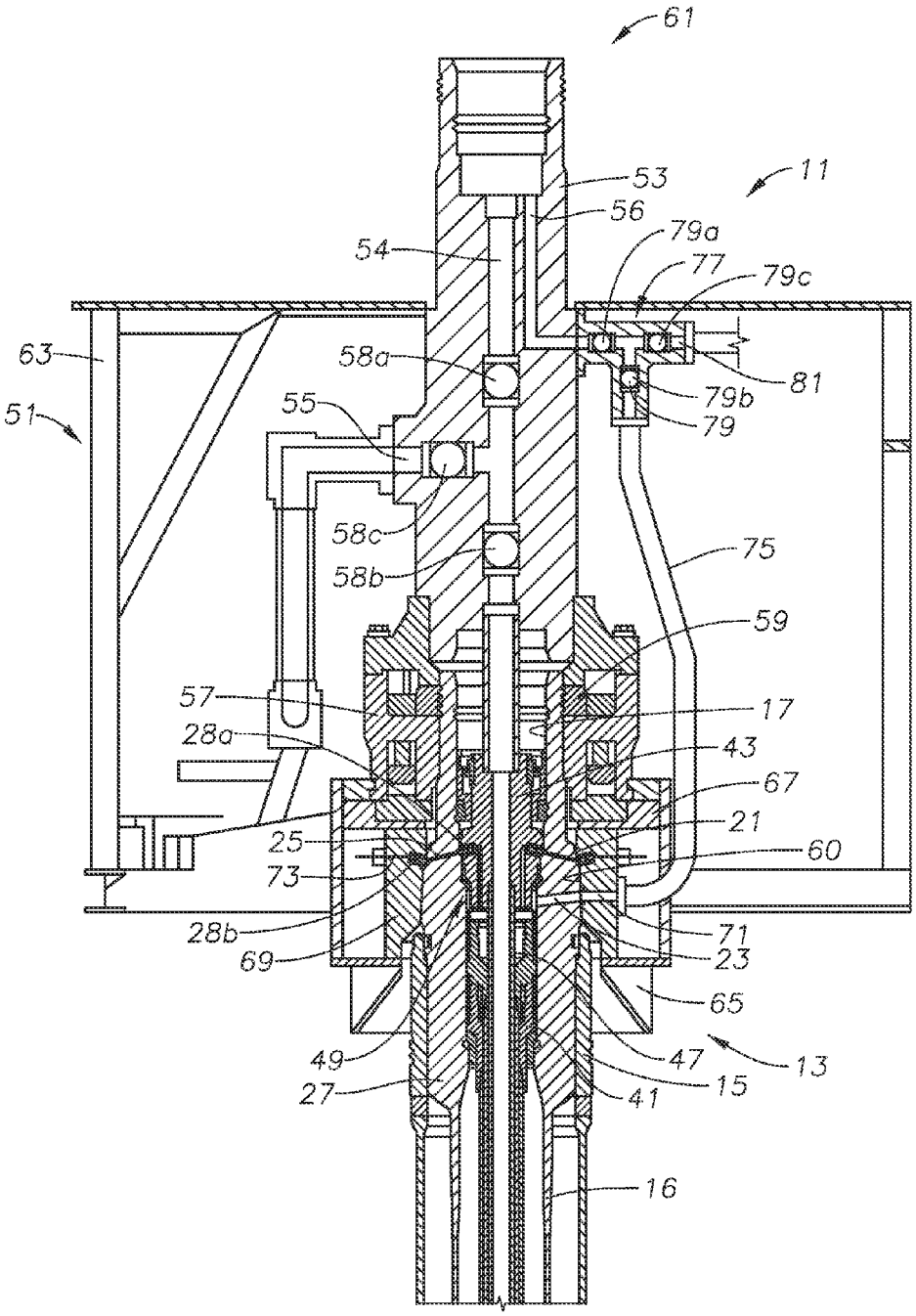
FIG. 2 is a section elevation view of the subsea wellhead assembly of FIG. 1, shown after the installation of the vertical tree assembly.
Figure 3:
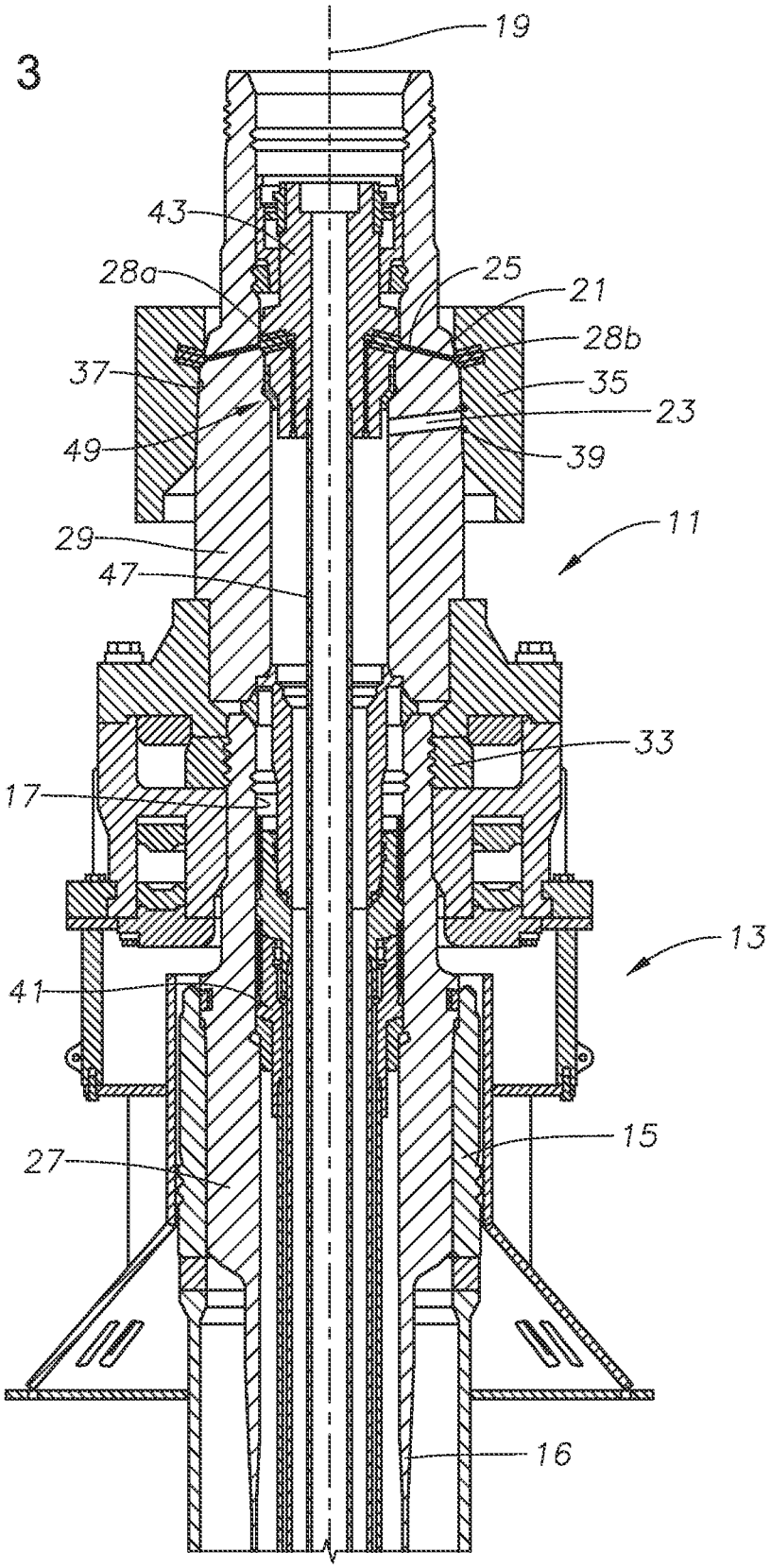
FIG. 3 is a schematic section view of a subsea wellhead assembly with a tubing head spool, in accordance with an embodiment of this disclosure, shown prior to the vertical tree assembly being installed.
Figure 4:
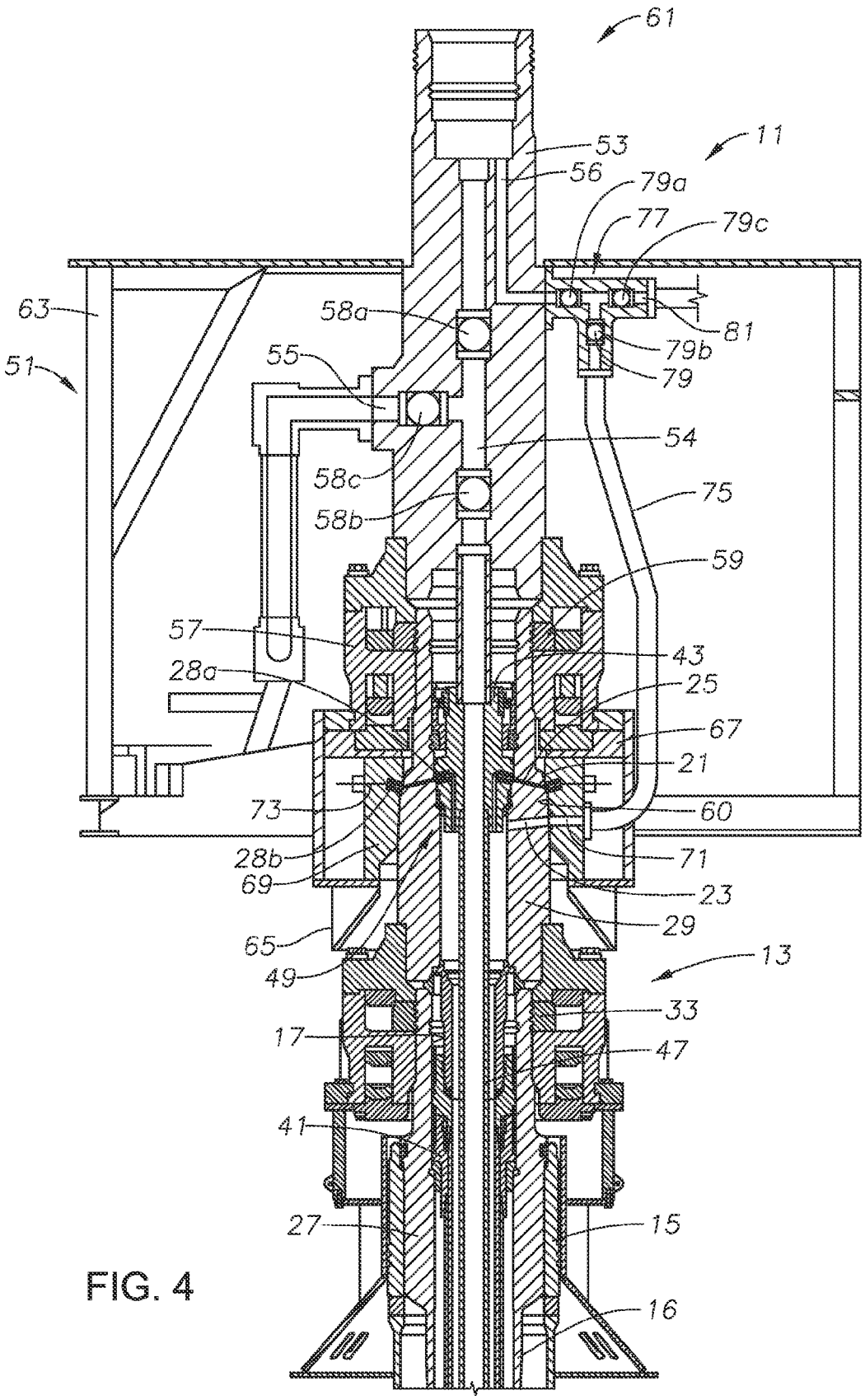
FIG. 4 is a section elevation view of the subsea wellhead assembly of FIG. 3, shown after the installation of the vertical tree assembly.

In the example of FIGS. 1-2, tubular housing assembly 13 includes wellhead housing 27 and no tubing head spool 29 (FIGS. 3-4). In such an example embodiment, housing annulus passage 23 extends through wellhead housing 27. Wellhead housing 27 can be, as an example, a high pressure subsea wellhead housing.

In the example of FIGS. 3-4, tubular housing assembly 13 includes wellhead housing 27. Housing annulus passage 23 in such an example extends through tubing head spool 29. Tubing head spool 29 is secured to an upper end of wellhead housing 27. The example of FIGS. 3-4 discloses a connector member having a series of dogs 33 that engage an outer profile of wellhead housing 27 to secure tubing head spool 29 to wellhead housing 27. However, other connector members known in the art can be used to secure tubing head spool 29 to wellhead housing 27. Wellhead connector 31 can connect tubing head spool 29 to wellhead housing 27.

Looking at FIGS. 1 and 3, blocking sleeve 35 can be mounted on tubular housing assembly 13. Blocking sleeve 35 is adapted to block housing annulus passage 23, and housing control line 25. Blocking sleeve 35 can have an axially extending opening so that blocking sleeve 35 can circumscribe tubular housing assembly 13. Blocking sleeve 35 can have a downward facing blocking sleeve landing surface 37 that can land on and engage housing tree interface surface 21 so that blocking sleeve 35 is supported on tubular housing assembly 13. Blocking sleeve 35 can include annulus seal 39 that forms a seal around the first end of housing annulus passage 23 which is located at an outer diameter of tubular housing assembly 13. In an embodiment of the disclosure, annulus seal 39 does not extend around blocking sleeve 35 or wellhead housing 27, but instead encircles the outlet of housing annulus passage 23. In alternate embodiments, a seal can be formed around annulus passage 23 with two circumferential seals; one encircling wellhead housing 27 above annulus passage 23 and the other encircling wellhead housing 27 below annulus passage 23.

Referring now to FIG. 1, casing hanger 41 is installed on a landing shoulder in axial bore 17. Casing hanger 41 is secured to a string of casing which extends into the well to a second depth. Casing hanger 41 is sealed to axial bore 17 by conventional casing hanger seals. The well will be drilled through wellhead assembly 11 and casing hanger 41 installed. Turning to FIG. 3, tubing head spool 29 can be installed after the well is drilled.

Tubing hanger 43 can be run and supported within axial bore 17. Tubing hanger 43 has a vertical bore 45 that extends completely through tubing hanger 43 and is coaxial with and is in fluid communication with axial bore 17. Tubing hanger 43 is adapted to be secured to a string of tubing 47 which extends into the well. Tubing hanger 43 has seal assembly 49 circumscribing tubing hanger 43 and forming a seal between an outer diameter of tubing hanger 43 and a surface of axial bore 17. Housing annulus passage 23 extends to axial bore 17 at a location axially below seal assembly 49. Seal assembly 49 can be a known tubing hanger seal.

Blocking sleeve 35 can be removed and vertical tree assembly 51 can be landed on tubular housing assembly 13. Vertical tree assembly 51 can include tree member 53 which is tubular and located axially above tubing hanger 43 when vertical tree assembly 51 is landed on tubular housing assembly 13. A standard wellhead to tree metal seal can be located between an lower end of tree member 53 and an upper end of tubular housing assembly 13. Tree member has a central tree bore 54 that extends through vertical tree assembly 51 and is collinear with axial bore axis 19. Tree member 53 has main lateral bore 55 for directing a flow of production fluid from the well. Central tree bore 54 registers with main lateral bore 55.

Tree member 53 also has tree annulus passage 56 extending through a sidewall of tree member 53. Tree member 53 has a number of production valves for controlling the flow of production and other fluids through vertical tree assembly 51. Production swab valve 58*a* is located along central tree bore 54 axially above main lateral bore 55. Production master valve 58*b* is located along central tree bore 54 axially below main lateral bore 55. Production wing valve 58*c* is located along main lateral bore 55.

A lower portion of vertical tree assembly 51 can circumscribe an upper portion of tubular housing assembly 13. Tree connector member 57 can circumscribe an upper portion of tubular housing assembly 13 and can have dogs assembly 59 that can engage an outer diameter profile of tubular housing assembly 13, removeably securing vertical tree assembly 51 to tubular housing assembly 13. A lower end of vertical tree assembly 51 can include tree wellhead interface surface 60. Tree wellhead interface surface 60 is a downward and inward facing sloped surface on an inner diameter of the vertical tree assembly 51. Tree wellhead interface surface 60 is sized and shaped to mate with housing tree interface surface 21. Housing tree interface surface 21 selectively engages tree wellhead interface surface 60, supporting vertical tree assembly 51 on the housing assembly 13.

At an opposite end of vertical tree assembly 51, tree member 53 has an upper interface 61 that includes a larger diameter section of central tree bore 54. Upper interface 61 has a profile on both an outer diameter of upper interface 61 and on a surface of the larger diameter section of central tree bore 54. Upper interface 61 can be used to engage and secure vertical tree assembly to a tree cap, BOP, workover package, or other subsea equipment. Tree annulus passage 56 has a first end at the upper interface and a second end at an outer diameter of tree member 53.

Vertical tree assembly 51 also includes tree frame 63. Tree frame 63 includes structural members to position and support components of vertical tree assembly 51. In the example of FIGS. 2 and 4, vertical tree assembly 51 has vertical posts that extend from the elevation of vertical tree assembly 51 to below tree connector member 57. Horizontal beams can connect between the vertical posts. At a bottom end of tree frame 63, an external centralizer 65 can help in orienting vertical tree assembly 51 as it is lowered over tubular housing assembly 13. Adjacent to external centralizer 65 can be sleeve frame 67. Sleeve frame 67 can extend from tree connector member 57 to external centralizer 65 and can house annulus sleeve 69. Annulus sleeve 69 has sleeve port 71 in fluid communication with housing annulus passage 23, and sleeve control line 73 in communication with housing control line 25.

Sleeve port 71 is also in fluid communication with external annulus passage 75. External annulus passage 75 extends outside of or external of tree member 53 and housing assembly 13. External annulus passage 75 is in fluid communication with both housing annulus passage 23 and tree annulus passage 56, providing a flow path between housing annulus passage 23 and tree annulus passage 56. Valve assembly 77 engages an outer diameter of tree member 53. Valve assembly is located between tree annulus passage 56 and external annulus passage 75 and can be used to control the flow of annulus fluids through external annulus passage 75, through housing annulus passage 23, and through tree annulus passage 56.

Valve assembly 77 has at least one annulus valve 79. In the embodiment of FIGS. 2 and 4 valve assembly 77 has three annulus valves 79. Valve assembly 77 has a tree open position to allow annulus fluid to flow into and out of tree annulus passage 56. In the tree open position the first annulus valve 79*a*, which is closest to tree member 53, is open to allow the flow of annulus fluid into or out of the tree annulus passage 56. Valve assembly 77 also has a housing open position to allow annulus fluid to flow into and out of housing annulus passage 23. In the housing open position the second annulus valve 79*b*, which is closest to a top end of external annulus passage 75, is open to allow annulus fluid to flow through external annulus passage 75 and into and out of housing annulus passage 23. A third annulus valve 79*c* is located proximate to annulus port 81. Annulus port 81 is a passage at an outer end of valve assembly 77 that is open to an outside surface of valve assembly 77. Annulus port 81 can be used to provide annulus fluids through valve assembly 77 and can be blocked when not in use. Alternately, a line from valve assembly 77 could cross over to central tree bore 54.

Various actuators, both hydraulic and mechanical, are mounted to vertical tree assembly 51 for actuating the various valves 58*a*, 58*b*, 58*c*, 79*a*, 79*b*, and 79*c*. Vertical tree assembly 51 has all of the required passages and valves of a subsea vertical tree. Vertical tree assembly 51 can be installed and removed as a single unit, without having to make multiple trips to remove various parts of wellhead control components in separate trips.

Looking at FIGS. 1 and 3, in an example of operation, the operator first installs base 15 on the sea floor. The operator drills the well to a first depth, installing conductor pipe and housing assembly 13 in base 15. Drilling riser will be employed to lower tubular housing assembly 13 and will remain in place until vertical tree assembly 51 is ready to be run. Blocking sleeve 35 will be installed on housing assembly 13 and blocking sleeve 35 will be in place while housing assembly 13 is being run. The operator drills the well to completion, installing casing strings conventionally.

Turning to FIGS. 2 and 4, the operator then installs the string of tubing 47 and lands tubing hanger 43 in housing assembly 13. The operator may wish to perforate before installing tubing 47 or after. The operator can then install plugs, for safety, to close off the tubing 47. The operator then removes the drilling riser and blocking sleeve 35 can be retrieved.

The operator then lowers vertical tree assembly 51. Vertical tree assembly 51 can be lowered in place by a riser that allows pressure testing from the surface. Once vertical tree assembly 51 is landed on housing tree interface surface 21, the operator can engage dogs assembly 59 with an ROV. The operator tests the various valves 58*a*, 58*b*, 58*c*, and 79*a*, 79*b*, 79*c*.

In the event reentry into the well is needed for workover operations, the operator can use a completion or workover riser with a choke and kill line, that fits around an outer profile of upper interface 61 of housing assembly 13. By opening annulus valves 79*a*, and 79*b* and leaving production wing valve 58*c* closed the operator can pump annulus fluids into the well below tubing hanger 43 through tree annulus passage 56, valve assembly 77, external annulus passage 75, sleeve port 71, and housing annulus passage 23. Alternately, annulus fluids can be pumped into the well through central tree bore 54, vertical bore 45, and tubing 47 and return to the surface through housing annulus passage 23, sleeve port 71, external annulus passage 75, valve assembly 77, and tree annulus passage 56.

In other alternate embodiments, instead of using a package that attached to upper interface 61, annulus fluids can be pumped into the well by way of annulus port 81. In such an embodiment, annulus valve 79*a* will remain closed and annulus valves 79*b* and 79*c* will be opened to allow annulus fluids to flow though valve assembly 77, external annulus passage 75, sleeve port 71, and housing annulus passage 23.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A wellhead assembly comprising:

a tubular housing assembly having a housing sidewall, an axial bore, and a housing annulus passage extending from the axial bore through the housing sidewall;

a tubing hanger adapted to be secured to a string of tubing and selectively landed in the housing assembly, the tubing hanger having a vertical bore in fluid communication with the axial bore;

a vertical tree assembly selectively landed on the housing assembly, the vertical tree assembly having a tree member located axially above the tubing hanger, the tree member having a lateral bore for directing a flow of production fluid from a well;

a tree annulus passage extending through a sidewall of the tree member;

an external annulus passage extending external of the tree member and the housing assembly, the external annulus passage in fluid communication with the housing annulus passage and the tree annulus passage; and a blocking sleeve adapted to block the housing annulus passage, wherein the blocking sleeve selectively circumscribes the housing assembly alternately with the landing of the vertical tree assembly on the housing assembly.

2. The assembly according to claim 1, wherein the housing assembly includes a tubing head spool, and wherein the housing annulus passage extends through the tubing head spool.

3. The assembly according to claim 1, wherein the housing assembly includes a subsea wellhead housing, and wherein the housing annulus passage extends through the subsea wellhead housing.

4. The assembly according to claim 1, further comprising a seal assembly circumscribing the tubing hanger and forming a seal between an outer diameter of the tubing hanger and a surface of the axial bore, and wherein the housing annulus passage extends to the axial bore at a location axially below the seal assembly.

5. The assembly according to claim 1, further comprising:

a housing control line extending from the axial bore through the housing sidewall;

an inner multi control coupling located at an inner end of the housing control line at the axial bore; and an outer multi control coupling located an outer end of the housing control line at an outer diameter of the housing assembly.

6. The assembly according to claim 5, wherein the vertical tree assembly further comprises an annulus sleeve, the annulus sleeve having a sleeve port in fluid communication with the housing annulus passage and the external annulus passage, and a sleeve control line in communication with the housing control line.

7. The assembly according to claim 1, wherein:

the housing assembly has a housing tree interface surface, the housing tree interface surface being an annular upward facing sloped surface on an outer diameter of the housing assembly;

the vertical tree assembly has a tree wellhead interface surface, the tree wellhead interface surface being a downward and inward facing slope surface on an inner diameter of the vertical tree assembly; and the housing tree interface surface selectively engages the tree wellhead interface surface, supporting the vertical tree assembly on the housing assembly.

8. The assembly according to claim 1, wherein the vertical tree assembly includes a dogs assembly, the dogs assembly selectively engaging an outer diameter profile of the housing assembly, removeably securing the vertical tree assembly to the housing assembly.

9. A wellhead assembly comprising:

a tubular housing assembly having, an axial bore, and a housing annulus passage having a first end located at an outer diameter of the housing assembly and a second end located at surface of the axial bore, the housing assembly further having a housing tree interface surface, the housing tree interface surface being an annular upward facing sloped surface on an outer diameter of the housing assembly;

a tubing hanger adapted to be secured to a string of tubing and selectively sealingly engaging the axial bore of housing assembly above the second end of the housing annulus passage, the tubing hanger having a vertical bore in fluid communication with the axial bore; and a vertical tree assembly selectively landed on the housing assembly, the vertical tree assembly having:

a tree member located axially above the tubing hanger, the tree member having a lateral bore for directing a flow of production fluid from a well;

a tree annulus passage with a first end at an upper interface of the tree member and a second end at an outer diameter of the tree member;

an external annulus passage extending external of the tree member and the housing assembly, the external annulus passage in fluid communication with the housing annulus passage and the tree annulus passage;

a valve assembly engaging the outer diameter of the tree member, the valve assembly having a tree open position to allow an annulus fluid to flow into and out of the tree annulus passage and having a housing open position to allow the annulus fluid to flow into and out of the housing annulus passage; and a tree wellhead interface surface, the tree wellhead interface surface being a downward and inward facing slope surface on an inner diameter of the vertical tree assembly that selectively engages the tree wellhead interface surface, supporting the vertical tree assembly on the housing assembly.

10. The assembly according to claim 9, wherein the housing assembly includes a tubing head spool, and wherein the housing annulus passage extends through the tubing head spool.

11. The assembly according to claim 9, wherein the housing assembly includes a subsea wellhead housing, and wherein the housing annulus passage extends through the subsea wellhead housing.

12. The assembly according to claim 9, wherein the vertical tree assembly further comprises an annulus sleeve, the annulus sleeve having a sleeve port in fluid communication with the housing annulus passage.

13. A method for completing a subsea well, the method comprising:

(a) providing a tubular housing assembly having a housing sidewall, an axial bore, and a housing annulus passage extending from the axial bore through the housing sidewall and landing a blocking sleeve on the housing assembly so that the blocking sleeve circumscribes the housing assembly and blocks the housing annulus passage;

(b) installing the housing assembly subsea at an upper end of the subsea well and performing drilling operations;

(c) securing a string of tubing to a tubing hanger and landing the tubing hanger in the housing assembly, the tubing hanger having a vertical bore in fluid communication with the axial bore and then removing the blocking sleeve from the housing assembly;

(d) providing a vertical tree assembly, the vertical tree assembly having a tree member, the tree member having a lateral bore for directing a flow of production fluid from the well and a tree annulus passage extending through a sidewall of the tree member, the vertical tree assembly further having an external annulus passage; and (e) landing the vertical tree assembly on the housing assembly so that the tree member is axially above the tubing hanger and so that the external annulus passage extends external of the tree member and external of the housing assembly and is in fluid communication with the housing annulus passage and the tree annulus passage.

14. The method according to claim 13, wherein the housing assembly includes a tubing head spool, and wherein the housing annulus passage extends through the tubing head spool, the method further comprising controlling an annulus fluid that flows through the external annulus passage, through the housing annulus passage, and into the well below the tubing hanger with at least one annulus valve.

15. The method according to claim 13, wherein the housing assembly includes a subsea wellhead housing, and wherein the housing annulus passage extends through the subsea wellhead housing, the method further comprising controlling an annulus fluid that flows through the external annulus passage, through the housing annulus passage, and into the well below the tubing hanger with at least one annulus valve.

16. The method according to claim 13, wherein the vertical tree assembly further comprises an annulus sleeve, the annulus sleeve having a sleeve port in fluid communication with the housing annulus passage and the external annulus passage, the method further comprising controlling an annulus fluid that flows through the external annulus passage, through the annulus sleeve, and into the well below the tubing hanger with at least one annulus valve.

17. The method according to claim 13, wherein a housing control line extends from the axial bore through the housing sidewall and the vertical tree assembly further comprises an annulus sleeve, the annulus sleeve having a sleeve control line in communication with the housing control line, the method further comprising performing a function in the well by communicating a control signal through the sleeve control line and into the well below the tubing hanger.

18. The method according to claim 13, wherein the vertical tree assembly includes a valve assembly, the valve assembly having an at least one annulus valve and engaging an outer diameter of the tree member, the method further comprising controlling a flow of an annulus fluid into the housing annulus passage and into the tree annulus passage with the at least one annulus valve.

* * * * *